United States Patent [19]

Malhas

[11] 3,997,159

[45] Dec. 14, 1976

[54] TENNIS TRAINING DEVICE

[76] Inventor: Farouk S. Malhas, 3520 W. Place, NW., Washington, D.C. 20007

[22] Filed: Feb. 1, 1972

[21] Appl. No.: 222,549

Related U.S. Application Data

[62] Division of Ser. No. 20,332, March 17, 1970, Pat. No. 3,653,660.

[52] U.S. Cl. ..... 273/29 A; 273/29 R

[51] Int. Cl.[2] ..... A63B 69/38

[58] Field of Search ..... 273/29 R, 29 A, 26 B; 150/1, 13, 35, 52 A, 52 E, 52 G, 52 J, DIG. 1, 1.6, 11.7, 3, 11, 12, 33, 5, 34, 48, 50, 51, 46, 23; 46/51, 52

[56] References Cited

UNITED STATES PATENTS

| | | | |
|---|---|---|---|
| 1,318,652 | 10/1919 | Farkas | 150/3 |
| 1,581,535 | 4/1926 | Granger | 150/3 X |
| 1,582,867 | 4/1926 | Callowhill | 150/46 |
| 1,647,679 | 11/1927 | Williams | 150/49 |
| 1,737,065 | 11/1929 | Thornton | 150/12 |
| 2,197,977 | 4/1940 | Halpin | 273/29 R |
| 2,396,021 | 3/1946 | Schloss | 150/52 G |
| 2,710,639 | 6/1955 | Farles | 150/11 X |
| 2,769,475 | 11/1956 | Fisher | 150/33 |
| 3,319,684 | 5/1967 | Calhoun | 150/12 X |
| 3,545,659 | 12/1970 | Libby | 150/33 |

*Primary Examiner*—Richard C. Pinkham
*Assistant Examiner*—T. Brown

[57] ABSTRACT

A device for use in learning, practicing, and perfecting a tennis serve comprising a flexible, substantially non-elastic tether and a weighted end portion is described. The tether is grasped at one end and swung forward using the motion associated with the exaggerated throwing of a baseball. The weighted end of the device forces the smooth, continuous follow-through motion required in a tennis serve.

3 Claims, 10 Drawing Figures

NET

LOOPING BEHIND BACK

IMPACT

FOLLOW THROUGH

FULL LOOP

BACK TO FIRST POSITION

TENNIS TRAINING DEVICE

This is a division of application Ser. No. 20,332 filed Mar. 17, 1970, now U.S. Pat. No. 3,653,660.

FIELD OF INVENTION AND BACKGROUND

This invention relates to a device for use in learning, practising, and perfecting the tennis serve. More particularly, the invention embraces a device comprising a flexible non-elastic tether and a weighted end. In use, the device is swung utilizing the motion associated with the exaggerated throwing of a baseball. The weight at the end of the tether forces the smooth, continuous follow-through motion required in a tennis serve.

Tennis is a game which requires fluidity of motion and an easy, simple, and a rhythmic wing that flows through all strokes of the game. These characteristics are especially important in the tennis serve. The service, therefore, must be natural, easygoing, smooth, accurate, steady, and simple. Since it is the opening stroke of every point, it determines whether the server is going to be in a commanding or a defending position. In an average tennis match, approximately 50 percent of all points are won by the serve. It is important that a beginner to tennis gain confidence. For complete confidence, it is necessary that the beginner have confidence in his serve.

Numerous books and articles are available directed to learning, practising, and perfecting one's tennis game. Uniformly, these books and articles recognize the above noted requirements of the serve and that the serve is the most difficult part of the tennis game for a beginner to learn and for advanced players to master. It has been said that while most "good" amateur players can hit an adequate forehand and backhand, and volley reasonably well, the disparity between their serve and that of the professional player is major. Notoriously, amateurs will hit their first serve with all their might—into the net; they will then be required, to avoid a double fault, to dish-up a soft second serve that anyone can handle. This loses points and undermines the confidence of the player, further destroying the effectiveness of his game.

Although the difficulty of the serve is uniformly recognized by tennis instructors, no effective, simple method has been devised to permit the beginner and amateur to learn and master the serve.

OBJECTS OF THE INVENTION

Accordingly, it is a primary object of the present invention to provide a device which is simple in construction which can be used by both amateur and professional to learn and perfect the tennis serve.

It is another object of this invention to provide a device which is simple in construction and which will permit a player to limber and exercise his tennis arm.

It is another object of this invention to provide an exercise which will enhance coordination, rhythm, and freedom of smooth movement, with emphasis on continuity, required for the tennis serve.

These and other objects of the invention will be readily apparent from the following description, with emphasis being directed to the drawing.

GENERAL DESCRIPTION OF THE INVENTION

Briefly, the objects of this invention are accomplished by constructing a device having a flexible tether looped at one end for receiving the wrist of the user. A weighted portion such as a pouch or sack large enough for receiving a plurality of tennis balls is at the other end. The length of the tether and end portion is the length of, or substantially the length of, a tennis racket. The tennis player will grasp the tether in the hand used to grasp his tennis racket and, standing in a tennis stance, will "serve" with the device using the motion used to throw a baseball. The pull of the device due to the weighted end forces the user's motion into a full extension of his arm. Repeated swings with the device, using precautions to ensure a complete follow-through, will give the user the fluidity of motion necessary to obtain the natural, easygoing, smooth, accurate, steady, and simple swing needed in the tennis serve.

Although it is recommended that the beginner utilize only one device according to this invention, referred to at times hereinafter as the SERV-SAK, applicant's trade name, after the initial motion is mastered more than one device can be utilized to provide improved coordination, timing, and rhythm. The SERV-SAK device of the present invention will be more readily apparent from the accompanying drawing wherein like numerals are employed to designate like parts, and wherein FIG. 1 is a perspective view of the device according to this invention;

FIG. 2 is an enlarged view illustrating the end portion partly cut away and open; and FIGS. 3*a*–3*h* are diagrammatic illustrations of the drill according to the present invention.

DETAILED DESCRIPTION AND DRAWING

Figure 1:
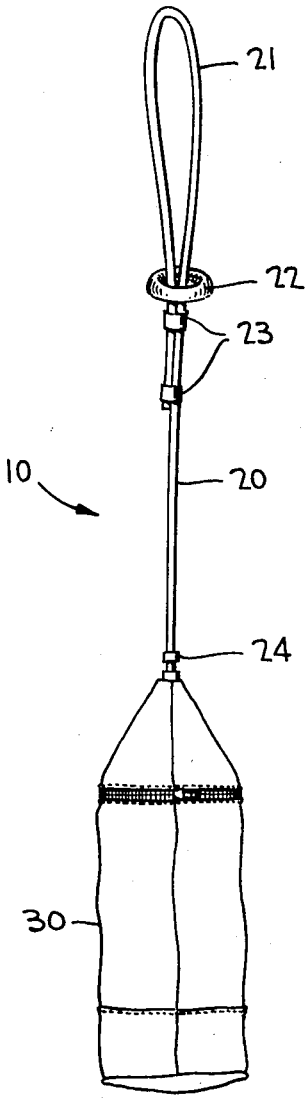
Figure 2:
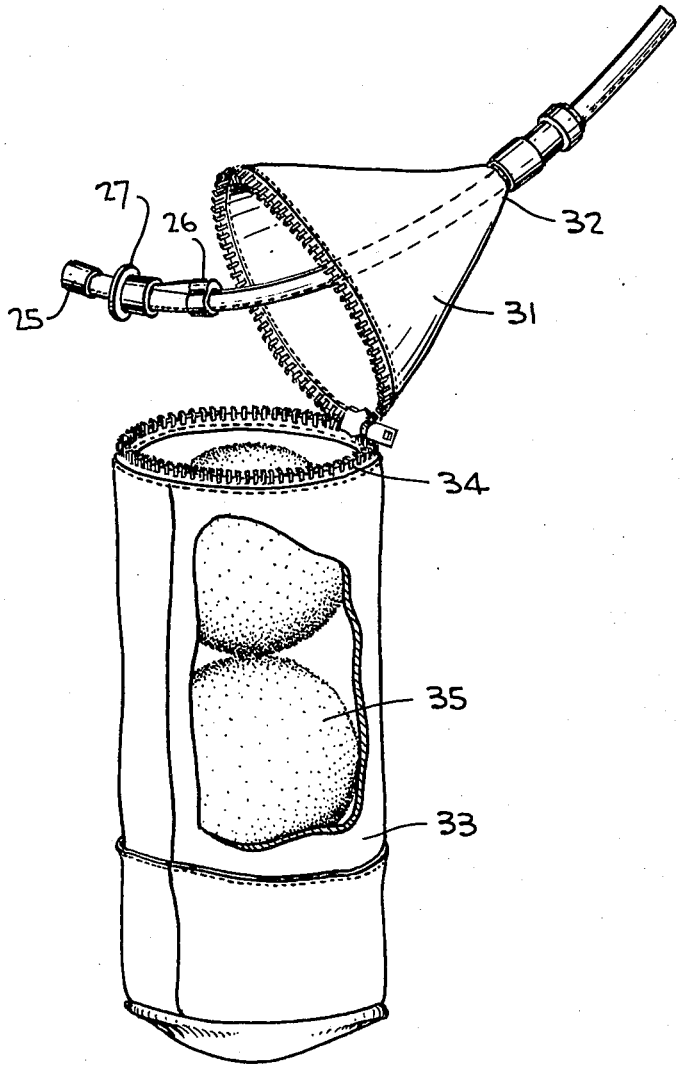

Referring to FIGS. 1 and 2 of the drawing, reference numeral 10 is directed to the complete device. The weighted end 30, according to the preferred embodiment of the drawing, comprises a pouch-like bag or sack having a container portion 33 and a top portion 31 openably connected by zipper means 34. As seen through the partially cut-away section, a plurality of balls 35 are contained within the pouch to provide weight. The pouch shown will accommodate three balls. The number of balls inserted in the pouch will depend upon the user and the amount of weight needed which will be determined by the user's strength and power. If more weight is desired, balls having a greater density than tennis balls, such as baseballs or the like, can be used in place of tennis balls, or a can containing tennis balls can be inserted into the pouch. Tether 20 comprises a looped end 21 into which the user will place his wrist and hand. As shown more clearly in FIG. 2, the tether can be made longer or shorter, e.g., if a player accustomed to a junior racket is practicing, by pulling it down into the cover portion of the pouch and releasing clip 26 from retaining ring 27, pushing the clip 26 to the desired position and again sliding ring 27 into engagement with the clip.

As apparent from the drawing, the device of the invention is extremely simple. The pouch portion is preferably fabricated from a soft leather, plastic, or cloth, with the tether preferably being a flexible material, but a material which is substantially non-elastic. Leather or a nylon or cotton line are preferred. When a plurality of the devices are used at the same time, the devices can be held in operable association by sliding the looped end of the tether through retaining ring 22 which is preferably made of an elastic material such as rubber or elastic plastic. This ring will hold the ends of the three units in working relationship. For the beginner, it may be desirable to slide the retaining ring toward the weighted end of the bags to enable the novice to feel the motion of the serve in a simplified manner. As the server becomes more confident, the retainer ring may be raised to the top. Maximum coordination and rhythm, as will be developed more fully, are required to keep the plurality of devices swinging in unison without separation when the washer is pulled up to the top.

Practice with the SERV-SAK of the type illustrated in the drawing will provide the rhythmic swing needed for the tennis serve which, in essence, is a chain reaction in which the body, arm, shoulder, and elbow must move with a smooth, coordinated rhythm. The movement must progress as the server transfers his weight from the ball of the left foot onto the toes when he reaches up to hit the ball. The climax of the wind-up comes as a blast at the point of impact when the racket contacts the ball. As the weight falls forward, the server regains his balance and is ready for the return. The power of the serve is a combination of speed, coordination, and rhythm of action. Drilling with the SERV-SAK of the present invention, referred to as the SERV-SAK Method, will enhance the coordination, rhythm, and freedom of movement needed for the serve. Practice, accelerated by the method, will improve the serve and make it a continuous fluid motion from start to finish. The method enables the server to relax and ultimately allows him to accomplish the required serve motion naturally, building up his confidence in his game. If the user does not employ the correct motion needed for the tennis serve and develop the required follow-through motion, the SERV-SAK—because of its erratic course—will immediately make the beginner aware of the improper movement. The erratic course of the SERV-SAK device is more pronounced when a plurality of the devices are swung together.

Figures 3A, 3B, 3C, 3D, 3E, 3F, 3G, 3H:
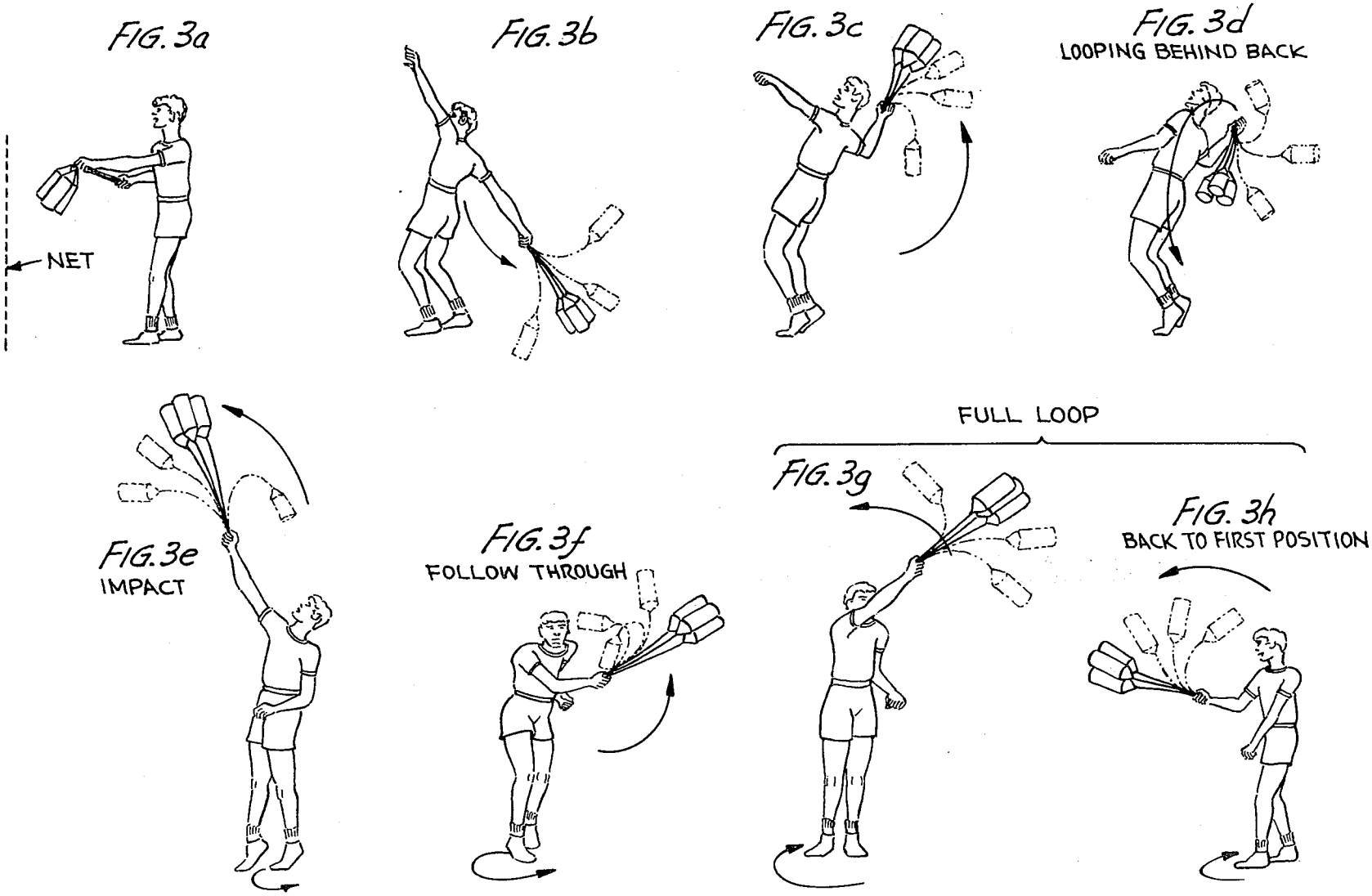

Referring now to FIG. 3, the entire series of steps of the SERV-SAK method is illustrated diagrammatically. In FIG. 3 the SERV-SAK device in full lines demonstrates its proper movement, whereas the phantom lines illustrate the erratic course of the device if the improper motion is used. In phase 1, FIG. 3*a*, the server, with left shoulder toward the net, stands at ease holding his SERV-SAK as shown and starts to swing backwards.

Phase 2, FIG. 3*b*, illustrates the server with knees slightly bent—the SERV-SAK starting to pull backward—causing the body to lean back. The left arm, in its simulated motion of throwing the tennis ball in the air, has risen well above the head of the server to release the ball. (No ball is used in the drill.)

Phase 3, FIG. 3*c*, illustrates the SERV-SAK starting to loop, pulling the weight of the body forward and upward as in a baseball throw. The sack is preparing to arch downward and away from the body in a wind-up motion.

Phase 4, FIG. 3*d*, shows that most of the body weight is forced to shift by the pull of the SERV-SAK reaching up totally on the left foot. The knees are straightened out in rhythm with the sack motion, the weight of which has come up from below the wrist, unwinding, moving up for the full blast action.

Phase 5, FIG. 3*e*, illustrates the climax of the serve—the full blast—reached on the toes causing the right leg to pull forward allowing the body to pivot in a natural follow-through. The SERV-SAK is at full speed and the left leg is straightened.

Phase 6, FIG. 3*f*, shows the complete follow-through, in which the SERV-SAK comes swinging down to its finish on the left side of the body; the server stepping forward with his left foot crossed diagonally to allow movement forward to the net or stay at the base line.

Phase 7, FIG. 3*g*, illustrates the server starting to follow-through on a repeated, continuous motion, the SERV-SAK being extended beyong phase 6 (FIG. 3*f*) to a leftside loop, pivoting the whole body to the starting position shown in phase 1.

The phantom lines of FIGS. 3*a–g* illustrate what will happen to the SERV-SAK in each step if the server does not utilize the proper coordination and rhythm. FIG. 3h illustrates more completely the erratic course of the SERV-SAK which will result in the event the server does not utilize the correct motion. This erratic motion readily advises the server that his motion must be corrected if he is to complete the movement. This is not the case when swinging a tennis racket.

The advantages of utilizing the SERV-SAK of the present invention in the perfecting of the tennis serve are readily apparent from the diagrammatic illustration of FIG. 3. Moreover, it will be apparent that the device can be useful in therapeutic drills and for developing rhythm and coordination for other sports including baseball, squash, and the like. Furthermore, it will be readily apparent that the device can be modified in various ways while still utilizing the principles of this invention. Thus, it is possible to modify the SERV-SAK to include a handle of the type used on a tennis racket to give the user a more complete tennis feel. Various modifications can be made in the sack or pouch portion. For example, it may be desirable to construct the weighted end as a completed unit. These features will be readily apparent to one skilled in the art and fall within the scope of the present invention.

It is claimed:

1. A tennis serve training device comprising a weight member having a flexible tether secured thereto and terminating in grip means for being gripped in the hand; said tether extending from said grip means to said weight member and the overall length of said weight member and tether being predetermined as an overall length of a tennis racket; said tether being flexible in any direction and longer than said weight member so as to bend substantially in response to a continuous swinging motion of the device in a simulated tennis serve to indicate improper serve motion by the user; said weight member being tubular, said tether being secured thereto in axial alignment therewith, and said weight member being configured to hold one or more tennis balls in axial alignment with said tether.

2. A tennis serve training device as set forth in claim 1, including means for predetermining the length of said tether.

3. A tennis serve training device as set forth in claim 2, including at least one identical device usable in plurality with said aforementioned device.

* * * * *